United States Patent [19]

Pamper

[11] Patent Number: 4,967,964

[45] Date of Patent: Nov. 6, 1990

[54] UNIVERSAL SPRAYING NOZZLE

[75] Inventor: Viktor Pamper, Budapest, Hungary

[73] Assignee: Duna Élelmiszer és Vegyiáru Kereskedelmi Vállalat, Budapest, Hungary

[21] Appl. No.: 415,207

[22] PCT Filed: Dec. 23, 1988

[86] PCT No.: PCT/HU88/00084

§ 371 Date: Oct. 26, 1989

§ 102(e) Date: Oct. 26, 1989

[87] PCT Pub. No.: WO89/06164

PCT Pub. Date: Jul. 13, 1989

[30] Foreign Application Priority Data

Dec. 30, 1987 [HU] Hungary ..... 6100/87

[51] Int. Cl.[5] ..... B05B 1/34

[52] U.S. Cl. ..... 239/464; 239/337; 239/489; 239/533.1

[58] Field of Search ..... 239/337, 340, 464, 466, 239/489, 490, 494, 533.1

[56] References Cited

U.S. PATENT DOCUMENTS 4,087,050 5/1978 Tsuji et al. ..... 239/490
4,884,750 12/1989 Werding ..... 239/337

FOREIGN PATENT DOCUMENTS 961535 11/1949 France .
1512626 2/1968 France ..... 239/494
957978 9/1982 U.S.S.R. ..... 239/466
1228916 5/1986 U.S.S.R. ..... 239/464
523404 7/1940 United Kingdom ..... 239/466
1254193 11/1971 United Kingdom .

*Primary Examiner*—Andres Kashnikow
*Assistant Examiner*—William Grant
*Attorney, Agent, or Firm*—Schweitzer Cornman & Gross

[57] ABSTRACT

An atomizing nozzle is disclosed, which is of simple, inexpensive construction while being capable of highly efficient atomization of liquids. A nozzle case is formed with a cylindrical recess for closely receiving a disc-shaped whirl body and separate nozzle element. The outer wall of the whirl body is formed with a plurality of inclined whirl passages which impart turbulence and whirl to the liquid. The nozzle element has a central, axial discharge passage which communicates with the whirl passages via a peripheral ring duct and a plurality of radial ducts formed on the upstream face of the nozzle member. An acceleration disc is fitted in the recess, on the upstream side of the whirl body. It is formed with a convergent central passage, a peripheral ring duct, and connecting radial ducts, providing for an accelerated flow of fluid to the several whirl ducts. A pressure-deformable regulation bell is placed against the upstream face of the acceleration disc. The bell has an eccentric inlet passage and defines a flow chamber which varies with the pressure at the incoming side, to compensate for its variations.

6 Claims, 6 Drawing Sheets

UNIVERSAL SPRAYING NOZZLE

BACKGROUND AND SUMMARY OF THE INVENTION

The present invention relates to a universal spraying nozzle for dispersing fluids under pressure, containing a disc-shaped vaporizing body placed in the bore of the nozzle case and a nozzle connected to said vaporizing body by its headwall, wherein the bore of the nozzle case is in connection with the surrounding space on the one hand and the space containing the fluid under pressure on the other hand; there are whirl ducts between a whirl body and the nozzle case, the nozzle has a central bore, and between the whirl body and the nozzle there is at least one ring duct and there are radial ducts that connect the ring duct and the central bore.

The polluting effect of the liquid power gases used in aerosol bottles is getting more and more obvious, therefore their elimination is more and more reasonable and the application of non-polluting power gases, e.g. air is emphasized considerably. That is why nozzles are manufactured where the perfect forming and dispersion of the spray is ensured exclusively by mechanical effects. In this case the active ingredient occupies a certain percentage of the volume of the container and the separate propellant gas is under overpressure not being united into the fluid. The volume rates are determined basically by the viscosity of the fluid. In this case, the dispersion is performed exclusively by the flow of the fluid under pressure in the spraying nozzle.

It is well known that the quality of the spray cloud vaporized by the spraying nozzles is good if the particles have extremely small dimensions, their distribution is uniform and they are produced continuously. In order to realize this quality, a pressure of about 3 atmospheres must be applied when using a liquid propellant gas. If the gas does not participate in forming the spray cloud because it is not soluble in the fluid or because it can not be mixed with it, at least 6 atmospheres must be applied in order to achieve the required quality of the spray cloud.

A description of nozzles of this type can be found e.g. in the French Patent No. 2,325,434. The nozzle of that patent contains ring ducts and a central whirl chamber in order to ensure a fine atomization of the fluid. However, the shape of the whirl chamber enables uncontrollable flows and the chamber does not contain elements that increase the speed of the fluid in the direction of the outflow. Therefore it is not suitable for dispersing relatively low pressured fluids in a form of fine mist, without using propellant gas.

According to U.S. Pat. No. 3,652,018, sulphur is applied in forming the dispersion cloud. This type of nozzle has ducts separated from each other by means of baffles. The four ducts flow into a central cylindrical mixing chamber and form the spray cloud in this way. However, this nozzle is not suitable for dispersing products that require higher quality standards, e.g. hair fixers, deodorants, air fresheners or insecticides. These fluids must have a particle size of between 5 and 10 microns in the air after dispersion, in order to ensure a quick evaporation on the one hand and a hovering state of the drops in the air on the other hand.

Another device that operates without propellant gas dissolved in the fluid to be dispersed is shown in the European Patent No. 0,000,688. Its main feature is that it has a nozzle core arranged in the body of the nozzle so that the feed ducts that are perpendicular to the internal wall of the nozzle body lead the fluid by a perpendicular impact into multi-stage switching ducts formed in the body of the nozzle, where a whirling flow of the substance occurs. From there on the material flows into a ring duct, then toward the outlet opening through other tangential ducts. It is evident that the turbulence between the switching ducts and the circular rings promotes the formation of the spray, but the perpendicular impact is not the best way because in the case of flowing liquids it causes a considerable decrease of the pressure. Therefore the motion energy of the liquid decreases. The changes of the direction of the flow have also a disadvantageous effect on the quality of the spray.

An object of the present invention is therefore to provide a universal spraying nozzle that ensures a dispersion of good quality without the existence of any power gas united in the active ingredient, simply mechanically without a need for shaping a complicated system of ducts. Therefore it is considerably simpler than the previous nozzles and accordingly it can be manufactured at considerably less cost.

According to the invention, the spraying nozzle contains a disc-shaped whirl body in the bore of the nozzle case and a nozzle connected to it by its headwall. There are whirl ducts between a whirl body and the nozzle case. The nozzle has a central bore, and between the whirl body and the nozzle there is at least one ring duct and ducts that connect the ring duct and the central bore. The whirl ducts, located between the whirl body and the nozzle case, and the generatrix of the outer wall of the whirl body make an acute angle, suitably an angle of between 5–45 degrees. The ring duct, between the whirl body and the nozzle, is formed in the nozzle, along its perimeter.

The whirl ducts can be shaped either on the external wall of the whirl body or in the internal wall of the nozzle case.

Preferably in front of the whirl body there is an acceleration disc that has a contracting bore in the direction of the whirl body. On the headwall toward the whirl body it has radial ducts and a ring duct along its perimeter.

The outer wall of the ring duct in the nozzle and/or in the acceleration disc is formed suitably by the mantle of the bore in the nozzle case.

Between the acceleration disc and a shoulder formed in the bore of the nozzle case, there is a regulation bell having an edge which butts on the acceleration disc and a flexible bottom plate formed with an eccentric bore.

A spraying nozzle head constructed in this way is suitable for producing extremely fine mist by means of a power gas not united into the active ingredient in the bottle; e.g. by means of air. Its shape is relatively simple and doe not require complicated tools. Therefore its manufacture is not expensive.

Further details of the invention will now be described by way of example with reference to the accompanying drawing.

DESCRIPTION OF PREFERRED EMBODIMENTS OF THE INVENTION

Figure 1:
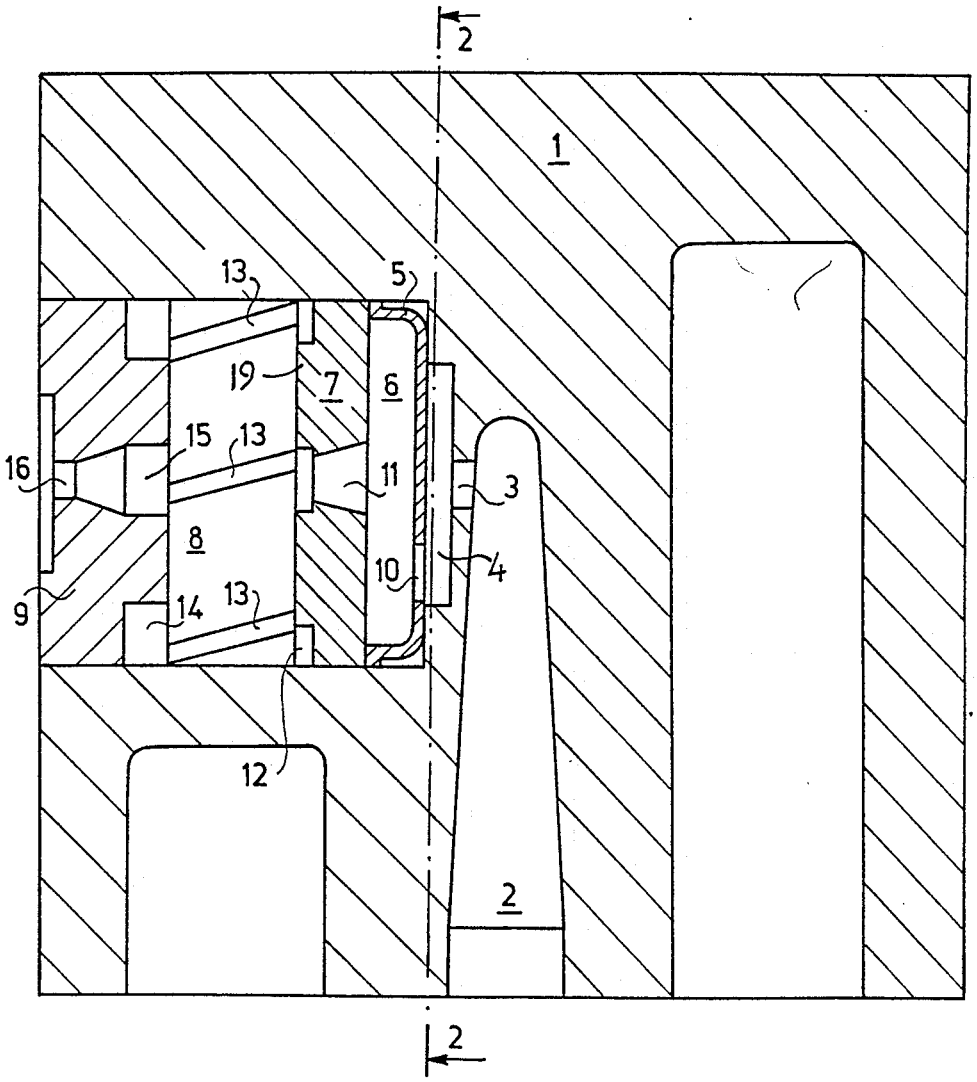
FIG. 1 is a longitudinal cross section view of an embodiment of the invention.

The embodiment shown in FIG. 1 consists of elements arranged in the bore of the nozzle case 1. The bore of the nozzle case 1 connects to the interior of the liquid bottle through an inlet passage 2 that is cylindrical at the bottom and conical at the top, and through an injection bore 3. The injection bore 3 opens into a forechamber 4 closed on the opposite side by the wall of a regulation bell 5.

The regulation bell 5 surrounds and partly defines a turbulence chamber 6 and joins with an acceleration disc 7. A whirl body 8 and nozzle 9 are arranged in the nozzle case 1, directly downstream of the acceleration disc.

The nozzle case 1 is generally made of plastic whose elasticity modules ensures the proper fixation of the elements pressed in its bore.

The material to be sprayed out enters through the inlet passage 2 and the injection bore 3, flows through the forechamber 4 and passes into the turbulence chamber 6 through the circular inlet bore 10 of the regulation bell 5.

The acceleration disc 7 has a concentric acceleration nozzle 11 through which the flow of the fluid is caused to contract in the direction of flow. The acceleration disc 7 is also provided with a ring duct 12 on its front wall.

On the outer wall of the whirl body 8, a plurality of whirl ducts 13 are formed, extending at a slight angle to a generatrix of the wall of tho whirl body. The whirl ducts 13 communicate with the ring duct 12 formed at the front of the acceleration disc.

The nozzle 9 also contains a ring duct 14 on its back wall, and is provided with a central bore 15 and a restricted outlet opening 16. There are radial ducts in both the acceleration disc 7 and in the nozzle 9, which cannot be seen in FIG. 1. They are described in detail later on, with respect to FIGS. 6, 7, 9 and 10.

Figure 2:
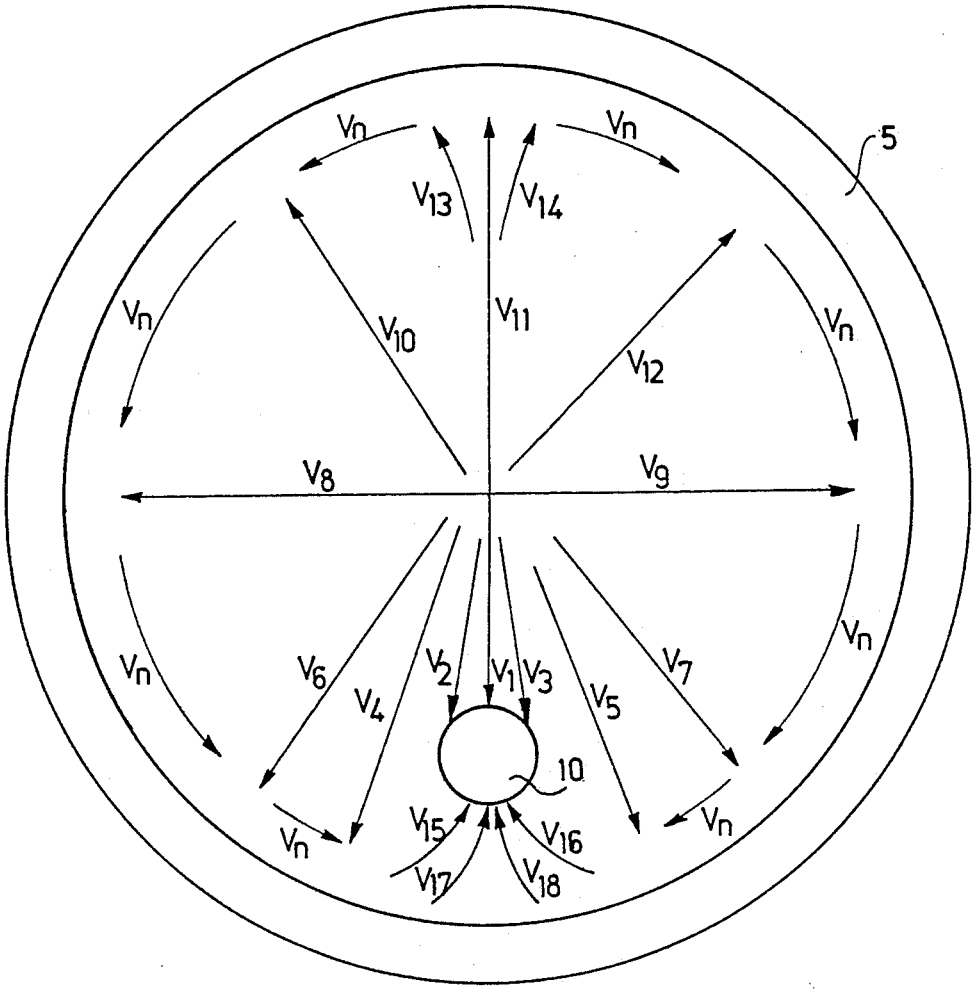
FIG. 2 is a cross sectional view as taken on line 2—2 of the spraying nozzle shown in FIG. 1.

In FIG. 2 it can be seen that the fluid that flows into the forechamber 4 through the injection bore 3 impacts against the wall of the regulation bell 5 in the middle, and so the whirling flow of the fluid begins. The flowing fluid enters the forechamber at the middle of the regulation bell 5 and disintegrates into $V_1 \ldots V_n$ components. After covering distances of different length the flow components reach the inlet bore 10. In FIG. 2 the components are shown so that the increase of their index number is in accordance with the distance covered in that direction. As a consequence of that, the energy of the fluid particles gradually decreases as an effect of the friction force. At the same time, an impact occurs between the different components which have different energy, and a considerably whirling occurs as they flow through the inlet bore 10.

Figure 3:
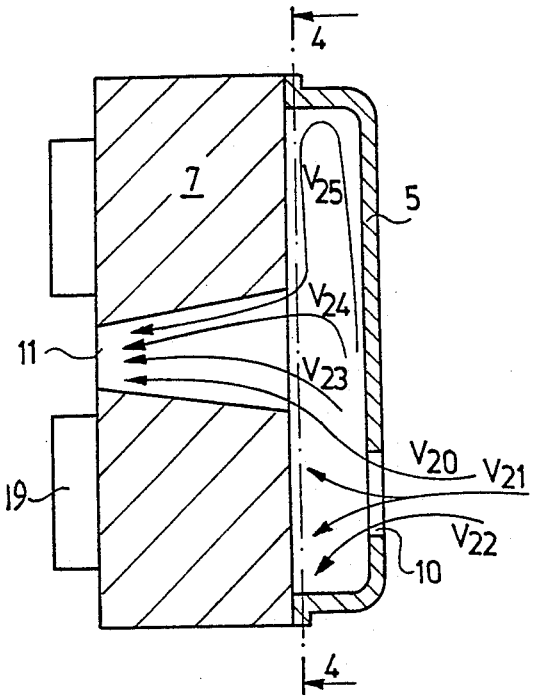
FIG. 3 is a cross sectional view of the regulation bell and the acceleration disc.
Figure 4:
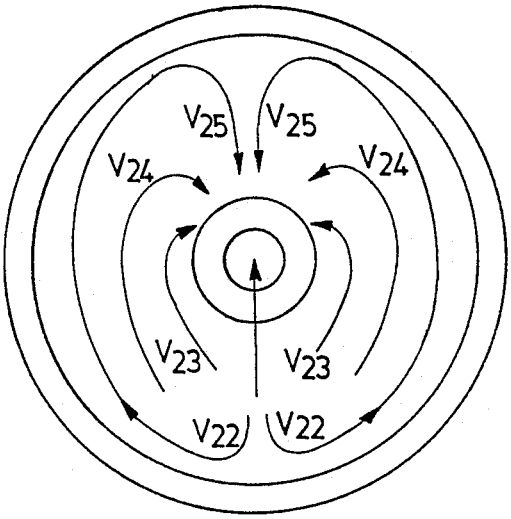
FIG. 4 is a cross sectional view as taken on line 4—4 of FIG. 3.

The way of the fluid particles that flow through the inlet bore 10 of the regulation bell 5 can be followed in FIG. 3. The components impact against each other once more on the back wall of the acceleration disc 7, then along this wall they turn round in arcs with different radii and flow to the contracting acceleration nozzle 11. Because of the fact that the different components cover different distances in different directions while going to the acceleration nozzle 11, the whirling, swirling characteristic of the fluid motion further increases.

Figure 5:
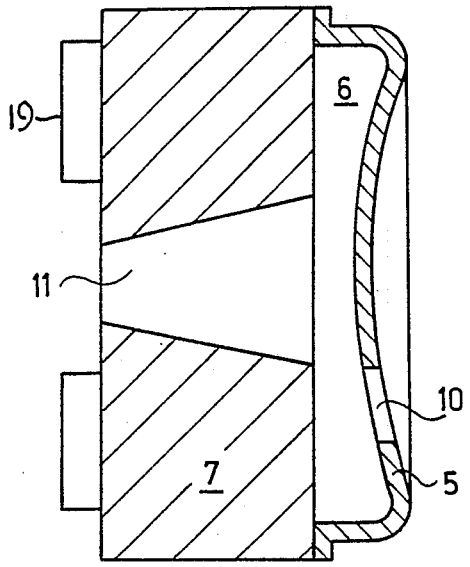
FIG. 5 shows the acceleration disc and the regulation bell of FIG. 3 under pressure.

In consequence of the effect of the fluid arriving under pressure the bottom plate of the regulation bell 5 strains (see FIG. 5) and this deformation also influences the current conditions. When the pressure is relatively high in the container, the regulation bell 5 strains considerably, and thus decreases the volume of the turbulence chamber 6. Accordingly the cross section of the flow is smaller, too. As the pressure of the incoming fluid decreases, the deformation of the regulation bell 5 gradually decreases also, and the cross section of the flow in the turbulence chamber 6 becomes correspondingly bigger. Accordingly, the device automatically compensates the differences generated by the change of pressure in the container, and ensures a uniform dispersion.

As previously mentioned, the particles of the fluid go from the turbulence chamber 6 to the acceleration nozzle 11. When the particles leave the accelerating nozzle at the downstream surface of the acceleration disc 7, the elementary particles have a whirling motion as an effect the previous impacts, and they even rotate around their own geometrical axis independently of their resultant direction of motion. All these motions are generated by the speed components of different direction and magnitude that effect the particles in the forechamber, in the turbulence chamber and in the acceleration nozzle 11.

Figure 6:
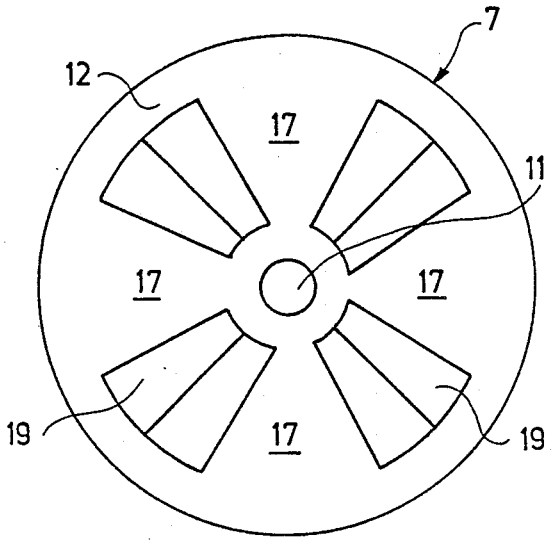
FIG. 6 shows a view of the front wall of the acceleration disc.
Figure 7:
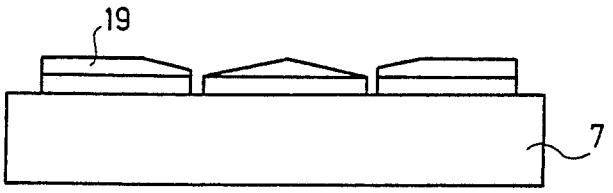
FIG. 7 shows a front view of a suitable construction form of the acceleration disc.

The particles that leave the acceleration nozzle 11 exit radially via radial ducts 17 on the front wall of the acceleration disc 7. The radial ducts 17 are formed by rib guides 19. These are prisms that are formed as is shown in FIGS. 6 and 7. They have radial ridges, and their height decreases along the two sides of the ridge. The illustrated embodiment contains four rib guides 19, but their number can be even bigger. Usually at least three rib guides 19 are necessary.

Figure 8:
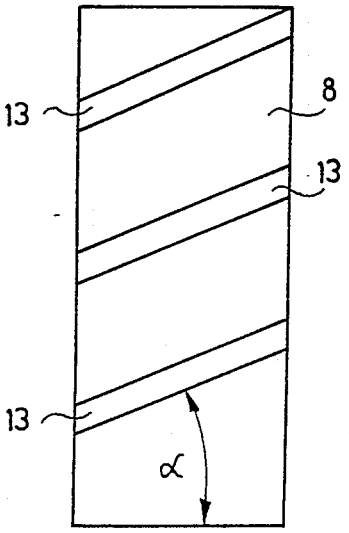
FIG. 8 shows a lateral view of a suitable construction form of the whirl disc.

Through the radial ducts 17 the fluid flows into the ring duct 12 that is shaped so that its external wall is formed by the wall of the bore of the nozzle case 1, as can be seen in FIG. 1. In the ring duct 12 the fluid particles flow around and go into the several whirl ducts 13 of the whirl body 8. The whirl ducts are formed in the outer wall of the whirl body 8 as shown in FIG. 8. The whirl ducts 13 and the generatrix of the wall of the whirl body 8 make an acute angle which usually is between 5–45 degrees and is about 30 degrees in the illustrated example. In the whirl ducts 13 the particles of the fluid get a further whirling impulse, and in this way they enter the ring duct 14 formed in the nozzle 9.

Several shapes are possible in forming the whirl ducts 13. In the device shown in the drawing, semicircular whirl ducts are provided, but the cross section of the whirl ducts can be triangular, trapezoid, etc. A further variation possible is to form the whirl ducts 13 in the wall of the bore of the nozzle case 1.

Figure 9:
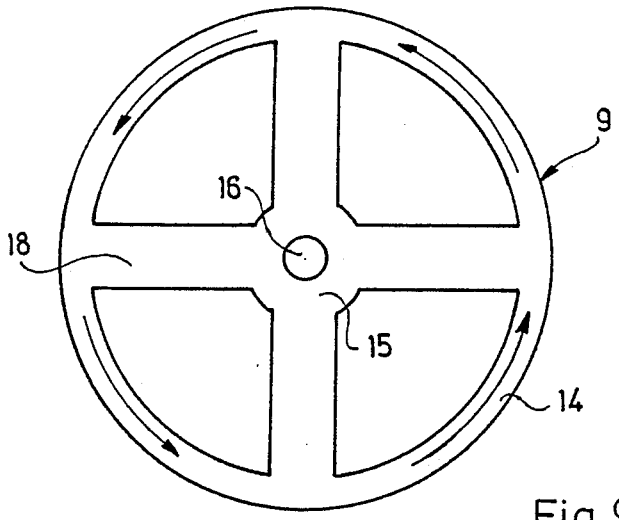
FIG. 9 shows a front view of a construction form of the nozzle.

As shown in FIG. 9, the fluid that flows in a whirling manner into the ring duct 14 leaves the ring duct through a plurality of radial ducts 18 leading to a central bore 15. The bore 15 operates in effect as a turbulence chamber, and a maximal whirling of the particles occurs inside.

Figure 10:
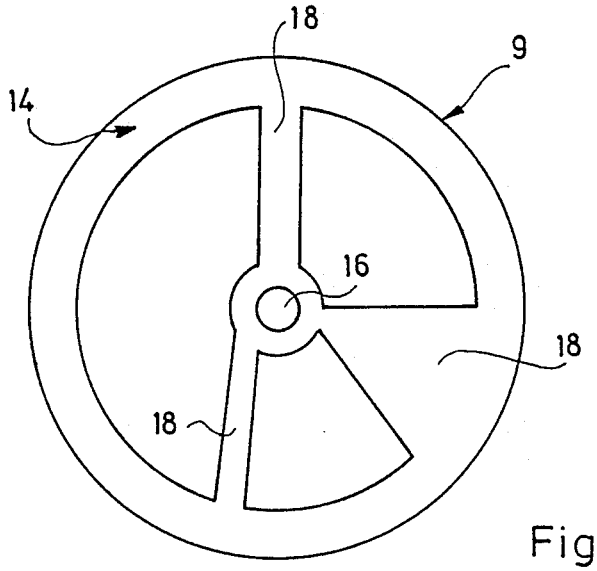
FIG. 10 is a front view demonstrating another possible construction form of the nozzle.

The radial ducts 18 can have either parallel or divergent walls as it can be seen in the modification of FIG. 10. In certain cases the ducts can be situated tangentially in relation to the central bore 15 shown on the lower part of FIG. 10.

The flowing particles of the fluid fill the ring duct 14 within a very short time and a s result of the force of the fluid that flows in continuously the particles flow to the central bore 15 through the radial ducts 18. The number of 15 the radial ducts 18 is variable, but at least two ducts are necessary.

The fluid that flows to the center through the radial ducts 18 goes to the central bore 15 that serves as a turbulence chamber, and there the whirling motion increases because of the considerable decrease of the volume. It not only promotes the breaking-up of the particles but also increases their speed considerably. The particles flow out of the outlet opening 16 with this increased speed.

Considering that the fluid to be dispersed has a speed and whirl that are getting greater and greater gradually from entering the inlet bore of the regulation bell through the acceleration disc and the whirl body and the nozzle, the speed and the whirl reach their maximum at the outlet opening 16. Therefore when the droplets of liquid are discharged into the air, they disintegrate into uncountable atomized particles as an effect of the untraceable, multi-directional and multi-dimensional speed components that overcome the internal cohesion forces of the fluid. And upon getting out to the air the particles burst like an explosion, and form a misty cloud. There is another important point in the fact that, during their way through the spraying nozzle, the particles of the fluid that have different speed touch each other and the wall of the nozzle components alternately. As a result, their temperature increases and a considerable difference of charge occurs because of the friction.

The spraying nozzle according to the invention produces a perfect mist and, at the same time, its construction is considerably simpler and its manufacture is much less expensive than that of the conventional designs. Of course, many other embodiments of the spraying nozzle are possible within the scope claimed in the attached claims.

I claim:

1. A universal spraying nozzle for discharging and finely atomizing fluids under pressure, which comprises (a) a nozzle case formed with a cylindrical recess communicating at its open end with atmosphere and at its closed end with a fluid inlet passage, (b) disc like whirl body received in said recess and defining with the walls of said recess a plurality of inclined whirl passages leading from one side to the other of said whirl body, (c) a nozzle member tightly received in said recess, on the downstream side of said whirl body, in the direction of fluid flow and having a central, axially directed discharge passage, (d) said nozzle member and said whirl body being in tight face to face contact, (e) means forming a ring passage between said nozzle member and said whirl body, communicating with the plurality of whirl passages, and a plurality of radial passages, communicating between said ring passage and said nozzle discharge passage.

2. A universal spraying nozzle according to claim 1, further characterized by (a) said ring passage and said radial passage being formed in the upstream face of said nozzle member and being closed in part by the down-stream face of said whirl body.

3. A universal spraying nozzle according to claim 2, further characterized by (a) said ring passage being formed in part by the wall of said cylindrical recess.

4. A universal spraying nozzle according to claim 1, further characterized by (a) said whirl passages being inclined at an angle of from 5 to 45 degrees to the generatrix of the outer wall of the whirl body.

5. A universal spraying nozzle according to claim 1, further characterized by (a) an acceleration disk being received in said cylindrical recess, on the upstream side of said in contact with said whirl body, (b) said acceleration disc being formed with a central axial acceleration passage of diminishing cross section in the direction of liquid flow therethrough, and (c) means forming a ring duct between said acceleration disc and said whirl body at their outer edge margins and a plurality of generally radial ducts communicating between said acceleration passage and said last mentioned ring duct.

6. A universal spraying nozzle according to claim 1, further characterized by (a) a deformable regulation bell being positioned in said recess, toward the upstream end thereof, (b) a disc-like member being positioned on the downstream side of an in sealing contact with said regulation bell, (c) said regulation bell having an inlet opening of restricted size and located substantially offset from the center thereof, (d) said regulation bell defining with said disk-like member a fluid chamber, and (d) said regulation bell being deformable under external fluid pressure to provide compensation for changes in fluid pressure at said inlet nozzle.

* * * * *